US006510923B1

(12) United States Patent
Veletovac et al.

(10) Patent No.: US 6,510,923 B1
(45) Date of Patent: Jan. 28, 2003

(54) CONTROL METHOD AND APPARATUS FOR A HYDRAULIC ELEVATOR USING ONLY LOAD PRESSURE DATA

(75) Inventors: Sead Veletovac, Dübendorf (CH); Luigi Del Re, Zürich (CH)

(73) Assignee: Wittur AG, Wiedenzhausen (DE)

( * ) Notice: Subject to any disclaimer, the term of this patent is extended or adjusted under 35 U.S.C. 154(b) by 0 days.

(21) Appl. No.: 09/868,668

(22) PCT Filed: Jan. 31, 2000

(86) PCT No.: PCT/CH00/00045

§ 371 (c)(1),
(2), (4) Date: Nov. 5, 2001

(87) PCT Pub. No.: WO00/46138

PCT Pub. Date: Aug. 10, 2000

(30) Foreign Application Priority Data

Feb. 5, 1999 (CH) ..... 225-99

(51) Int. Cl.[7] ..... B66B 1/28
(52) U.S. Cl. ..... 187/285; 187/275
(58) Field of Search ..... 187/277, 285, 187/286, 272, 275

(56) References Cited

U.S. PATENT DOCUMENTS 4,418,794 A * 12/1983 Manco ..... 187/275
4,726,450 A * 2/1988 Fossati et al. ..... 187/286
5,040,639 A 8/1991 Watanabe et al.
5,266,756 A * 11/1993 Hatano ..... 187/285
5,281,774 A * 1/1994 Masaki ..... 187/253
5,289,901 A * 3/1994 Fargo ..... 187/275
5,374,794 A * 12/1994 Holmes ..... 187/275
5,522,479 A * 6/1996 Jo ..... 187/275
5,635,689 A * 6/1997 Shepard et al. ..... 187/285
RE36,022 E * 1/1999 Blain ..... 187/275

FOREIGN PATENT DOCUMENTS

EP A2382939 8/1990
WO WO 9834868 8/1998

* cited by examiner

*Primary Examiner*—Jonathan Salata
(74) *Attorney, Agent, or Firm*—Birch, Stewart, Kolasch & Birch, LLP

(57) ABSTRACT

A method for controlling a hydraulic elevator whose car can be displaced by a hydraulic drive mechanism by hydraulic oil fed through a cylinder line or evacuated from said hydraulic drive mechanism by a pump that cooperates with a first control valve unit and a second control valve unit, wherein the flow the hydraulic oil is controlled by a measuring device and operation of the elevator can be controlled and regulated by a control apparatus. The load of the elevator car is determined by a load pressure sensor detecting pressure $P_Z$ in the cylinder line and is controlled preferably in a constant manner by changing the control of the second control valve unit in such a way that movement of the elevator car can be controlled in a very precise manner. When the elevator car is descending, the dropping pressure $P_Z$ in the cylinder line is regulated by changing the first control valve unit in such a way that the descending movement of the elevator-cabin can also be controlled in a very precise manner.

12 Claims, 3 Drawing Sheets

Figure 1:
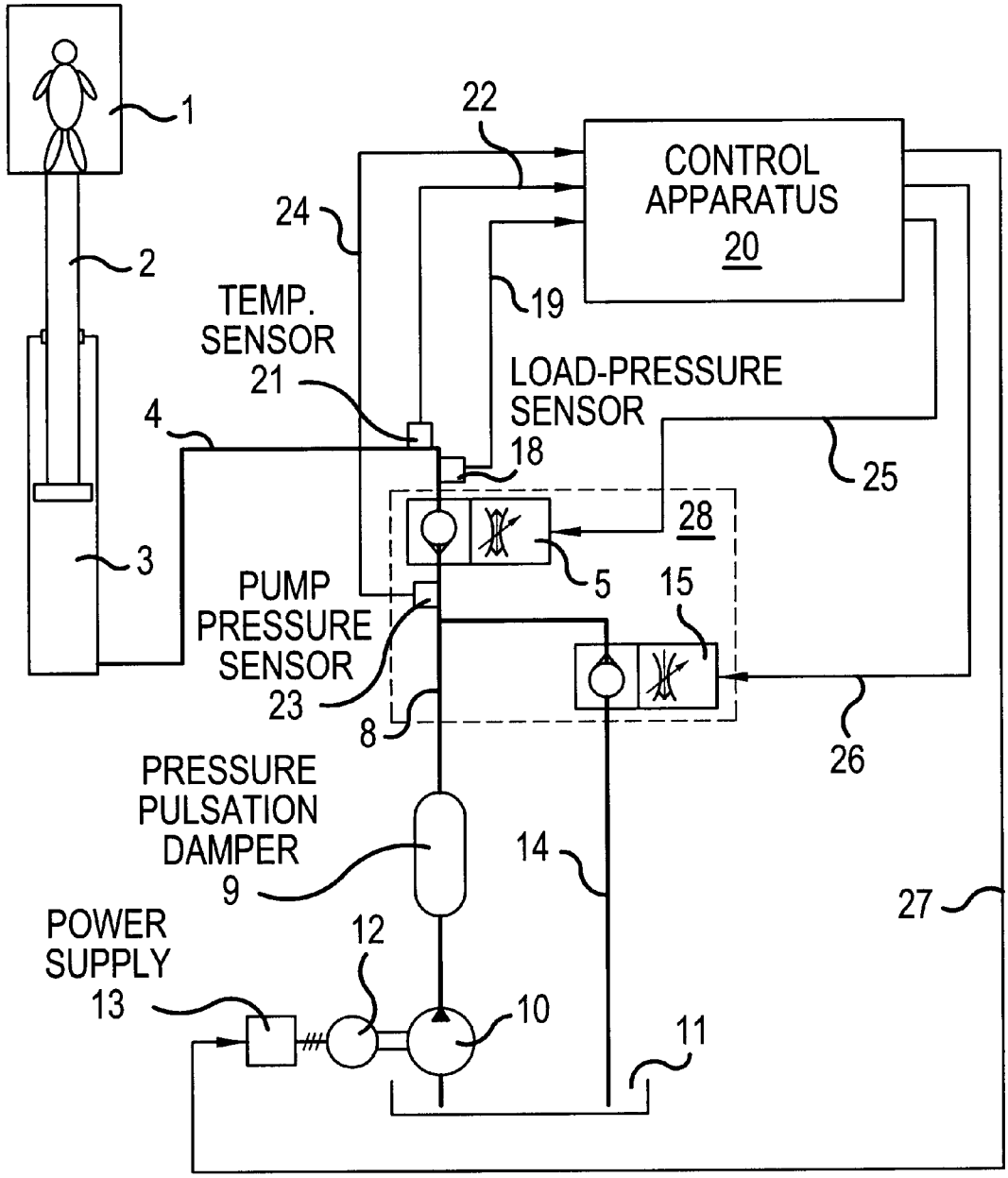

CONTROL METHOD AND APPARATUS FOR A HYDRAULIC ELEVATOR USING ONLY LOAD PRESSURE DATA

This application is the national phase under 35 U.S.C. § 371 of PCT International Application No. PCT/CH00/00045 which has an International filing date of Jan. 31, 2000, which designated the United States of America and was not published in English.

The invention relates to a method for controlling a hydraulic elevator and to a hydraulic elevator device.

Hydraulic elevators are employed advantageously in residential and industrial buildings. They can serve for the vertical transport of persons and/or freight.

U.S. Pat. No. 5,522,479 discloses a control unit for a hydraulic elevator, in which there are two pressure sensors, one of which is arranged on that side of a nonreturn valve facing the pump, while the other is installed on that side of the nonreturn valve facing the hydraulic drive cylinder. The signals from the two pressure sensors are fed to a controller which determines the rotational speed of the electric motor driving the pump. The speed of the elevator traveling up and down is thereby regulated via the quantity of hydraulic oil conveyed per unit time.

U.S. Pat. No. 5,040,639 discloses a valve unit for an elevator, which is assigned a pressure sensor by means of which the pressure in the line leading to the hydraulic drive of the elevator can be detected. Compensation of the pressure prior to the starting phase becomes possible with the aid of this pressure sensor. Moreover, the main valve is assigned a lifting sensor which is required in order to obtain information or, the flow of the hydraulic oil in the starting phase of an upward travel of the elevator.

WO-A-98/34868 discloses a method and a device for controlling a hydraulic elevator, in which the speed of the elevator car can be detected by means of a flowmeter. In this case, with the aid of the signal from this flowmeter, either the rotational speed of the electrical motor driving the pump is controlled or regulated or the opening position of a valve is varied, depending on the operating situation. A changeover of the control variable therefore takes place during the movement of the car. Careful coordination of the control and regulating parameters is consequently a precondition for operation which is as jolt-free as possible, and this necessitates a considerable outlay.

Moreover, such a flowmeter supplies a signal relating to the movement of the elevator car only when the elevator car has already been set in motion. Consequently, the actual start-up operation, which, however, is highly essential to traveling comfort, cannot be regulated.

The object on which the invention is based is to specify a method and device, in which the entire operation, from standstill up to maximum speed and to standstill again, can be controlled or regulated reliably, while the outlay in terms of control and regulation is at the same time to be minimal, to be precise dispensing with additional means determining the thrbughLlow quantity of the hydraulic oil.

Said object is achieved, according to the invention, in a method of the generic type, and, in a device.

Figure 2:
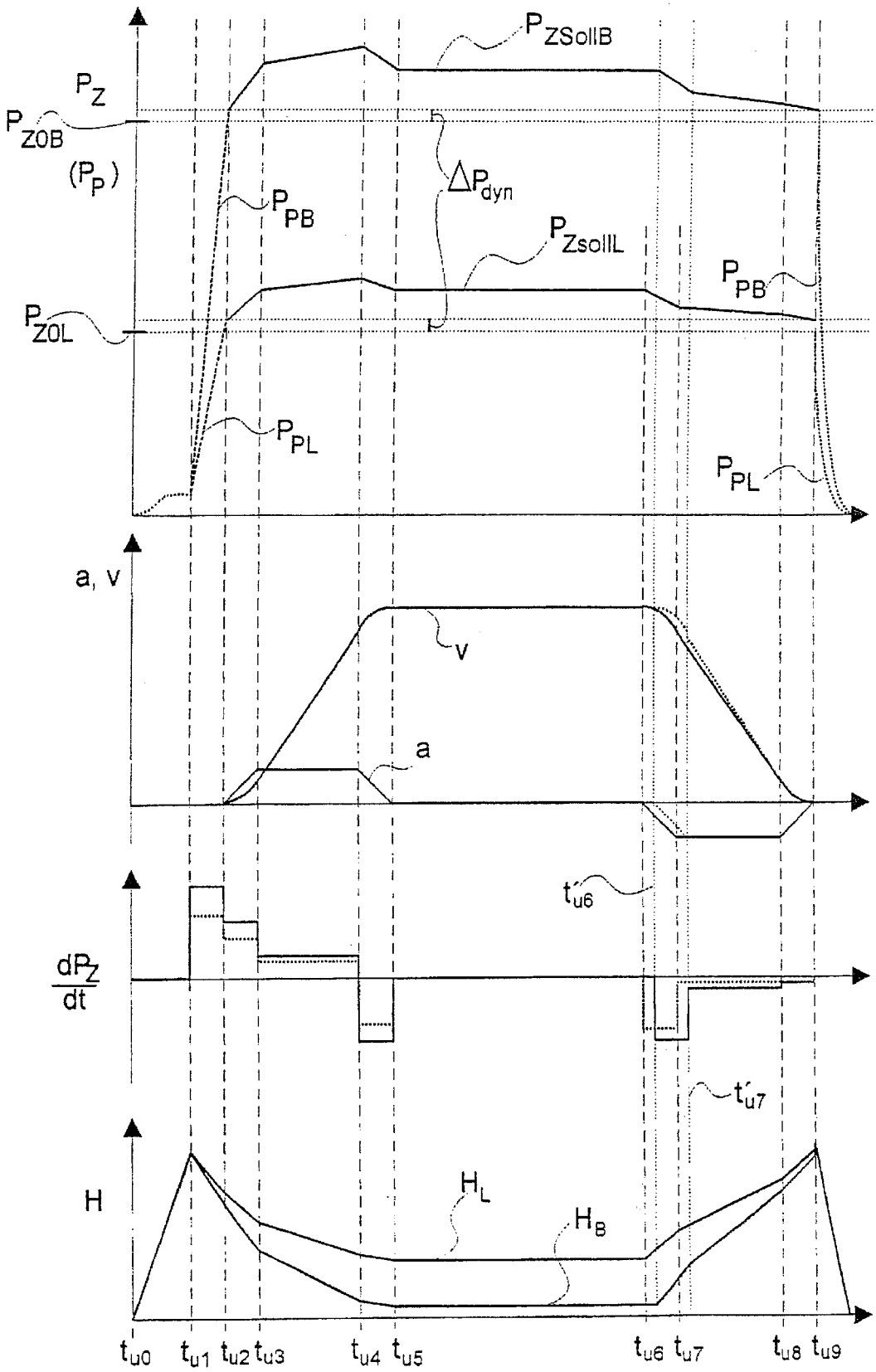
Figure 3:
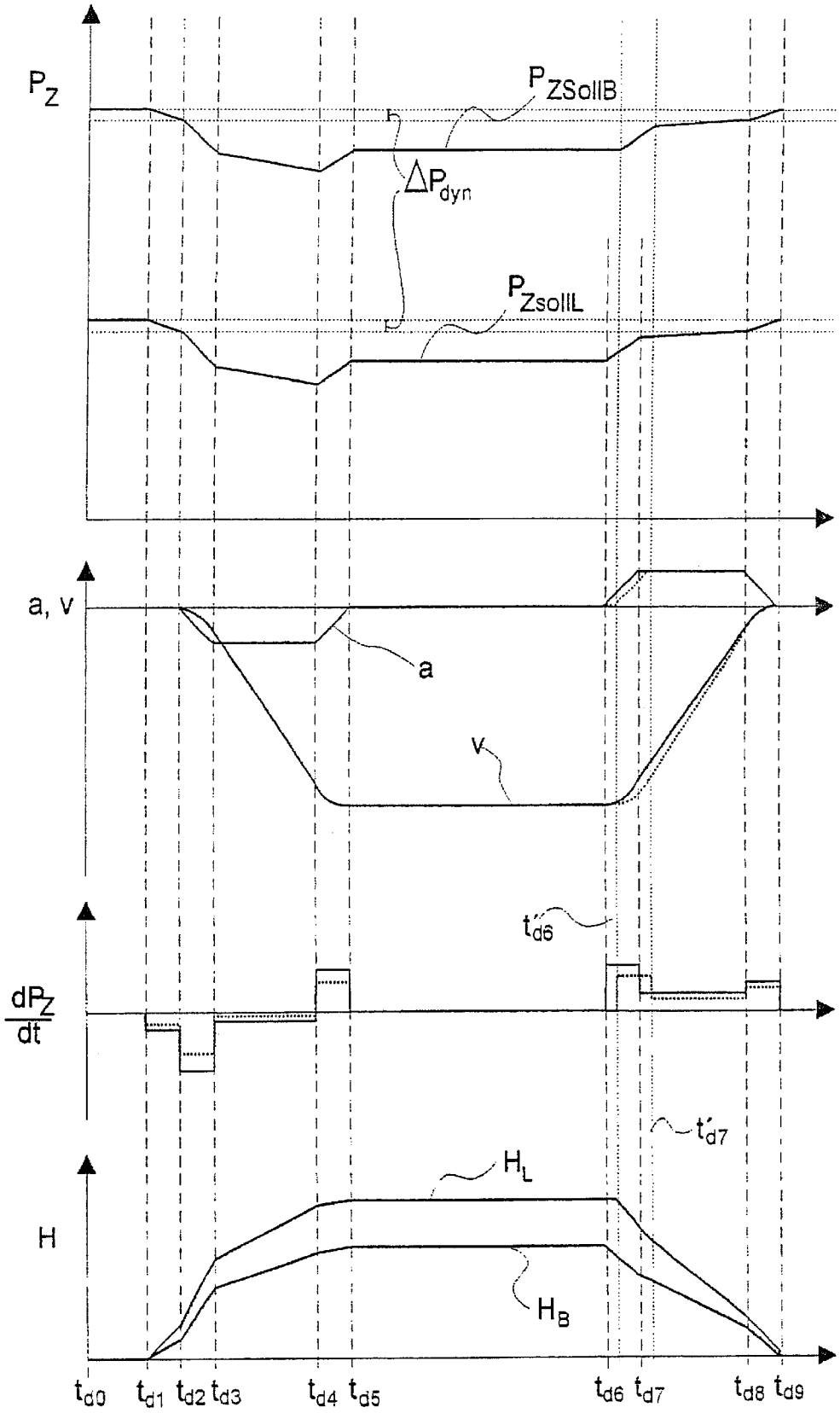

An exemplary embodiment of the invention is explained in more detail below with reference to the drawing in which:

FIG. 1 shows a diagram of the hydraulic elevator together with the device for controlling the latter, FIG. 2 shows graphs for an upward travel and FIG. 3 shows graphs for a downward travel.

In the figure, 1 denotes an elevator car of a hydraulic elevator, said car being capable of being moved by a lifting piston 2. The lifting piston 2 forms, together with a lifting cylinder 3, a known hydraulic drive. Connected to this hydraulic drive is a cylinder line 4, through which hydraulic oil can be conveyed. The cylinder line 4 is connected, at the other end, to a first control valve unit 5 which combines within it at least the functions of a proportional valve and of a nonreturn valve, so that it behaves either in the same way as a proportional valve or in the same way as a nonreturn valve, depending on how the control valve unit 5 is activated, which is still to be discussed. The proportional valve function may in this case be achieved in a known way by means of a main valve and a pilot control valve, the pilot control valve being actuated by an electric drive, for example a proportional magnet. The closed nonreturn valve holds the elevator car 1 in the respective position.

The control valve unit 5 is connected, via a pump line 8 in which a pressure pulsation damper 9 may advantageously be arranged, to a pump 10, by means of which hydraulic oil can be conveyed out of a tank 11 to the hydraulic drive. The pump 10 is driven by an electric motor 12 which is assigned a power supply part 13. A pressure $P_p$ prevails in the pump line 8.

Between the control valve unit 5 and the tank 11 there is a further line carrying hydraulic oil, to be precise a return line 14, in which a second control valve unit 15 is arranged. According to the invention, this control valve unit 15 allows the almost resistanceless return of the hydraulic oil from the pump 10 into the tank 11 when the pressure $P_P$ has exceeded a particular threshold value. The pressure $P_P$ consequently cannot appreciably exceed said threshold value. The situation is such, then, that this threshold value can be varied by means of an electrical signal, so that this control valve unit 15 can assume a pressure regulating function in a similar way to a known proportional valve. To achieve this function, too, it is possible, as in the case of a proportional valve, to resort in a known way to a main valve and a pilot control valve which is actuated by a proportional magnet capable of being activated electrically.

According to the invention, the cylinder line 4 has located in it, preferably directly at the corresponding connection of the control valve unit 5, a load-pressure sensor 18 which is connected to a control apparatus 20 via a first measuring line 19. The control apparatus 20 serving for operating the hydraulic elevator is thus able to detect which pressure $P_Z$ prevails in the cylinder line 4. This pressure $P_Z$ reproduces the Load on the elevator car 1 when said car is at a standstill. It will also be described later how control and regulating operations can be influenced and operating states determined with the aid of this pressure $P_Z$. The control apparatus 20 may also consist of a plurality of control and regulating units.

Advantageously, the cylinder line 4 has arranged on it, again preferably directly at the corresponding connection of the control valve unit 5, a temperature sensor 21 which is connected to the control apparatus 20 via a second measuring line 22. Since hydraulic oil has a viscosity which varies markedly with its temperature, the control and regulation of the hydraulic elevator can be markedly improved when the temperature of the hydraulic oil is included as a parameter in control and regulating operations. This is also to be described in detail.

Advantageously, there is a further pressure sensor, to be precise a pump-pressure sensor 23, which detects the pressure $p_p$ in the pump line 8 and which is advantageously arranged directly at the corresponding connection of the pump line 8 to the control valve unit 5. The pump-pressure sensor 23 likewise transmits its measurement value to the control apparatus 20 via a further measuring line 24.

A first control line 25 leads from the control apparatus 20 to the control valve unit 5. This control valve unit 5 can thereby be controlled electrically from the control apparatus 20. In addition, a second control line 26 leads to the control valve unit 15, so that this, too, can be controlled from the control apparatus 20. Moreover, a third control line 27 leads from the control apparatus 20 to the power supply part 13, with the result that the motor 12 can be switched on and off, but, if appropriate, the rotational speed of the motor 12 and consequently the delivery amount of the pump 10 can be influenced from the control apparatus 20.

By the control valve units 5 and 15 being activated from the control apparatus 20, it is determined how the control valve units 5 and 15 behave in functional terms. When the control valve units 5 and 15 are not activated by the control apparatus 20, the two control valve units 5 and 15 behave basically the same way as a differently pressurizable nonreturn valve. When the control valve units 5 and 15 are activated by the control apparatus 20 by means of a control signal, they act as proportional valves.

It may also be mentioned, here, that the two control valve units 5 and 15 are advantageously combined in a valve block 28, as indicated in the figure by a broken line surrounding these two units. The advantage of this is that the outlay in terms of assembly on the building site of the hydraulic elevator is reduced.

Before the essence of the invention is dealt with in detail, the basic functioning will first be explained: with the elevator car 1 at a standstill, it is essential that the control valve unit 5 then be closed, which, as already mentioned, is achieved in that the latter does not receive any control signal from the control apparatus 20 via the signal line 25, that is to say it acts as a nonreturn valve. The control valve unit 15, too, may be closed, but this is not necessarily always the case. It is thus possible that, even with the elevator car 1 at a standstill, the pump 10 runs, that is say conveys hydraulic oil, but that the conveyed hydraulic oil flows back into the tank 11 via the control valve unit 15. As a rule, however, at a standstill, the two control valve units 5 and 15 do not receive any control signals from the control apparatus 20, so that only the nonreturn valve function is possible in both cases. The electrically nonactivated control valve unit 5 closes automatically as a result of the action of the pressure $P_Z$ which the elevator car 1 generates, when this pressure $P_Z$ is higher than the pressure $P_P$. It has already been mentioned that, in this state, the load-pressure sensor 18 indicates the load caused by the elevator car 1. In this case, according to the invention, the effective load on the elevator car 1 is determined and is transmitted to the control apparatus 20. The control apparatus 20 can thus detect whether the elevator car 1 is empty or loaded and the size of the load is therefore also known.

When the elevator car 1 is to move in the upward direction, the power supply part 13 is first activated by the control apparatus 20 via the control line 27 and consequently the electrical motor 12 is set in rotation, with the result that the pump 10 begins to run and conveys hydraulic oil. The pressure $P_P$ in the pump line 8 thereby rises. As soon as this pressure $P_P$ exceeds a value correlated with the pressurization of the nonreturn valve of the control valve unit 15, the nonreturn valve of the control valve unit 15 opens so that the pressure $P_P$ initially cannot exceed this value. If this pressure value is lower than the pressure $P_Z$ in the cylinder line 4, which will usually be the case, the control valve unit 5 remains closed, and no hydraulic oil flows into the cylinder line 4. As a result, switching on the pump still does not bring about any movement of the elevator, because, in this case, the total quantity of hydraulic oil conveyed by the pump 10 is conveyed back into the tank 11 via the control valve unit 15. In order to achieve a movement of the elevator car 1, then, according to the invention the control apparatus 20 can control the proportional valve function of the control valve unit 15 via the signal line 26, so that a greater hydraulic resistance is set at the control valve unit 15.

This makes it possible, then, to increase the pressure $P_P$ until the necessary quantity of hydraulic oil can flow into the cylinder line 4 through the control valve unit 5. In this case, part of the stream of hydraulic oil conveyed by the pump 10 flows back into the tank 11 via the control valve unit 15. That part of the stream of hydraulic oil conveyed by the pump 10 which is not led back into the tank 11 via the control valve unit 15 flows through the control valve unit 5 acting as a nonreturn valve into the cylinder line 4 via the control valve unit 5 due to the prevailing pressure difference, that is to say lifts the elevator car 1. Continuous control of the hydraulic oil flowing to the lifting cylinder 3 is thereby possible, without the rotational speed of the pump 10 having to be regulated. The pump 10 needs to be designed only such that it can supply a delivery amount of hydraulic oil sufficient for the maximum speed of the elevator car 1, at the nominal rotational speed and under the maximum expected counterpressure, the customary reserve factors and other margins having to be taken into account.

It may also be noted, here, that the throughflow through the control valve unit 5 can be determined from the pressure difference, for example according to the following formula in the case of a given temperature:

$$Q = k_q \frac{A_v}{c_f} (\Delta p_v)^{3/2}$$

$A_v$ being the valve surface, $C_f$ being a likewise known spring rigidity, $k_q$ being an empirically determined coefficient, and $\Delta p_v$ being the measured pressure difference across the control valve unit 5. If the valve surface $A_v$ is known, the throughflow and consequently the car speed can be estimated, which markedly improves the regulatability of the car speed. If such a continuous calculation is carried out by the control apparatus 20, redundant data on the movement of the elevator car 1 can also be obtained in this way. This also applies to the continuous integration of the throughflow measurement values. By a comparison of the values determined by such calculations and of the data, based on these calculations, For time spans in which specific distances are covered with data on distances covered, which are supplied by switching elements arranged in the car shaft, the accuracy with which the speed is determined can be improved considerably.

The above-mentioned pressure difference $\Delta p_v$ may be replaced approximately by the difference in the current measurement values for the pressure $P_Z$ and the pressure $p_{ZO}$ prior to the commencement of the car movement for particular portions of the movement, appropriate correcting factors having to be used. If the pump-pressure sensor 23 is present, commencement of the car movement is calculated accurately by means of the difference in the pressures $P_Z$ and $P_P$. The throughflow quantity is therefore determined considerably more accurately than in U.S. Pat. No. 5,040,639 initially mentioned and is not restricted to the commencement of movement, that is to say to very low speeds of the elevator car 1. At least during the start-up operation, the determination of the throughflow quantity, taking into account the pressure difference $\Delta p_v = P_Z - P_{ZO}$, is sufficiently accurate, so that the start-up operation can be regulated reliably without an actual flowmeter, even in the absence of the pump-pressure sensor 23.

By the nonreturn valve of the control valve unit 5 being opened, the pressure $P_Z$ measured by the load-pressure sensor 18 rises. The pressure rise detected by the load-pressure sensor 18 therefore indicates the opening of the nonreturn valve of the control valve unit 5 even before the elevator car 1 has been set in motion, since the pressure build-up is initially used up in compression work and in order to overcome the frictions during standstill. It is possible, then, according to the invention, to control or regulate the start-up phase for the elevator car 1 solely by means of this pressure rise. It is possible at the same time that the proportional valve of the control valve unit 15 is activated by the control apparatus 20 to a greater or lesser extent, depending on the pressure $P_Z$ measured by the load-pressure sensor 18, because, as already mentioned, the control valve unit 15 is such that, like the control valve unit 5, it acts as a nonreturn valve when there is no control signal and acts as a proportional valve when it is activated by the control apparatus 20 via the control line 26. The amount of the control signal in this case determines the degree of opening of the proportional valve.

According to the invention, therefore, the control of the speed of the elevator car 1 during upward travel can be carried out by means of the signal from the load-pressure sensor 18 by a variation in the degree of opening of the proportional valve of the control valve unit 15. It will also be shown that, according to the invention, the entire upward travel and also the downward travel can be controlled or regulated with the aid of the load-pressure sensor 18 and a desired-value generator for the load pressure. Regulation is therefore possible by means of the time-dependent and/or distance-dependent variation in the desired value for the pressure and comparison with the value determined by the load-pressure sensor 18.

During downward travel, the pump 10 normally remains switched off. In this case, the control of the hydraulic oil flowing out of the lifting cylinder 3 back to the tank 11 through the cylinder line 4 is carried out solely by the activation of the proportional valve of the control valve unit 5. The hydraulic oil flows from the pump-side connection of the control valve unit 5 through the return line 14. It passes at the same time through the control valve unit 15.

According to the invention, only the signal from the load-pressure sensor 18 is evaluated, in order to control the commencement of movement of the elevator car 1. This may be carried out by an evaluation of the time profile of the pressure $P_Z$. When the elevator car 1 is at a standstill, the load-pressure sensor 18 supplies the current load, as already mentioned.

During downward travel, the control valve unit 5 is opened, using its proportional valve function, by means of a characteristic curve dependent on the measured load signal, the pressure $P_Z$. As soon as the pressure $P_P$ in the pump line 8 thereby opens the nonreturn valve of the control valve unit 5, the value of the pressure $P_Z$ measured by the load-pressure sensor 18 falls. This indicates that the elevator car 1 can move, so that the corresponding control procedure can be started by the control apparatus 20. The actual movement then commences as soon as the pressure drop exceeds a specific minimum value, the magnitude of which is determined by frictional losses and the compressibility of the hydraulic oil. The size and gradient of the drop advantageously make it possible to have evidence of the acceleration which acts on the elevator car 1. Advantageously, by integration, the speed, too, and furthermore, by further integration, the distance covered by the elevator car 1 can be determined from the acceleration. Advantageously, data determined in this way are subjected to a plausibility check and, with a view to the required safety, are also compared with other data sources, such as, for example, with position indicators which serve, in conjunction with the elevator control, for initiating crawling travel and the halt of the elevator car 1.

Since the load on the elevator car 1 is determined when the latter is at a standstill, it is possible to forecast when this pressure will be exceeded due to the start-up of the pump 10 and to the activation of the control valve unit 15, so that the control valve unit 5 opens. It is thus possible that the rise in the pressure $P_P$ in the pump line 8 is reduced in steps or continuously by a variation In the activation of the control valve unit 15. The object according to the invention, that the start-up operation be capable of being controlled with high sensitivity, is thus achieved. It is therefore also possible, within the scope of the invention, for the control apparatus 20 to be self-adjusting adaptively. The control apparatus 20 may contain as experimental values preprogramlmed values which are automatically adapted during operation.

It has already been mentioned that the pump-pressure sensor 23 is advantageously present. It is consequently possible for the pressure PF generated in the pump line 8 by the pump 10 and influenced by the second control valve unit 15 to be determined by means of this pump-pressure sensor 23, so that the pressure in the pump line 8 can be measured and therefore the stepped or continuous change in the reduction of the pressure rise can, if appropriate, also be regulated. The control apparatus 20 therefore does not have to manage with the forecastable data for the pressure rise. Since it can generate additional data, it can effectively regulate the pressure $P_P$. At the same time, the automatic adaptation of the control apparatus 20 is even easier and can be carried out more efficiently.

This advantageously affords a further possibility, to be precise that the difference between the pressure $P_Z$ determined by the load-pressure sensor 18 and the pressure $P_P$ determined by the pump-pressure sensor 23 can be formed in the control apparatus 20, and that this difference can be used for determining the flow of hydraulic oil in the cylinder line 4. Throughflow measurement is consequently possible, so that a flow-meter, as in the known prior art, is superfluous, thus providing cost benefits. A plausibility check, already mentioned, is also possible.

To implement the function of determining the flow of hydraulic oil, it is advantageous if the pump-pressure sensor 23 is designed as differential-pressure sensor determining a differential pressure $P_D$ which corresponds to the difference between the pressure $P_Z$ prevailing in the cylinder line 4 and the pressure $P_P$ prevailing in the pump line 8. Higher accuracy is consequently achieved.

It is advantageous to include the measurement value of the temperature sensor 21, because the properties of the hydraulic oil, in particular its viscosity, change with its temperature. If the control apparatus 20 can take into account measurement values of the temperature sensor 21 in the control, then, in turn, the control accuracy can be improved, because, in particular, the calculation of the throughflow of hydraulic oil, taking into account the pressure difference, also becomes more accurate.

FIG. 2 shows idealized graphs for an upward travel. The uppermost graph, designated as the $P_Z$ graph, shows the profile of the desired values for the pressure $P_Z$ for two different states of the elevator car 1 (FIG. 1), to be precise the curved line $P_{zdesL}$ for the empty elevator car 1 and the curved line $P_{zdesP}$ for a loaded elevator car 1. Before the commencement of an upward travel, the respective load is determined by the load-pressure sensor 18 (FIG. 1). The corresponding values, to be precise $P_{ZOL}$ for the empty elevator car 1 and $P_{ZOB}$ for the loaded elevator car 1, are depicted on the $P_Z$ axis.

The second graph, designated as the a, v graph, shows the desired values for acceleration and speed for the movement of the elevator car 1 during upward travel. The curve a shows the acceleration and the curve v the speed.

The third graph, designated as the $dP_Z/dt$ graph, shows the curve profile of the time derivation of the desired value of the pressure $P_Z$, that is to say the necessary change in the desired value of the pressure $P_Z$ in the individual phases of the upward travel. The curve illustrated by an unbroken line is an example of one specific load. An example of another load is shown as a broken line.

In the fourth graph illustrated as bottommost, designated as the H graph, the stroke of the valve spindle of the control valve unit 15 (FIG. 1) is illustrated. As mentioned before, during upward travel the control of movement takes place by the activation of this control valve unit 15.

The time axis t is common to all four graphs. On this time axis are illustrated individual time points $t_{u0}$ to $t_{u9}$ which represent characteristic time points within the framework of control and regulation. The references to the individual subgraphs are illustrated by broken lines.

An updward travel of the elevated car 1, then, is described below with reference to this graph. The starting command for upward travel takes place at the time point $t_{u0}$. At this time point, the control apparatus 20 (FIG. 1) determines the current value of the load-pressure sensor 18. Two values are depicted in the $P_Z$ graph. In one case, the elevator car 1 is empty and the current value of the pressure $P_Z$ is $P_{ZOL}$. In the second case, the elevator car 1 is loaded and the current value of the pressure $P_Z$ is $P_{ZOB}$. As a result of the starting command mentioned, the pump 10 (FIG. 1) is switched on. It runs up and begins to convey hydraulic oil. Consequently, it first builds up an only very low pressure, because the hydraulic oil conveyed by the pump 10 flows back to the tank 11 via the control valve unit 15 acting as a nonreturn valve. The low pressure which builds up is correlated with the force of the spring of the nonreturn valve 15. This phase is concluded at the time point $t_{u1}$. It can be seen from the H graph that the control valve unit 15 opens fully due to the build-up of the pressure in the pump line 8, since said control valve unit is not activated.

It should be mentioned, in this case, that this pressure can be measured only when, according to an advantageous embodiment of the invention, the pump-pressure sensor 23 is present.

During the period of time from $t_{u0}$ to $t_{u1}$, the control apparatus 20 calculates how the pressure in the pump line 8 is to be built up in the subsequent phase, the period of time from $t_{u1}$ to $t_{u2}$, so that the movement of the elevator car 1 can commence at the time point $t_{u2}$. A lower pressure is necessary when the elevator car 1 is empty and a higher pressure when the elevator car 1 is loaded. According to the invention, the pressure is to be built up at a different rate, so that the movement of the elevator car 1 commences after a time which is always the same. As mentioned before, the information on the load of the elevator car 1 is available to the control apparatus 20. The control apparatus 20 knows as a constant the load of the empty elevator car 1, characterized by a pressure $P_{ZOL}$ From this value and the measured initial value $P_{ZO}$, that is to say, for example, with the elevator car 1 loaded, the value $P_{ZOB}$, the control apparatus 20 calculates, for example, the load ratio $P_{ZOB}/P_{ZOL}$ which thus reproduces the current load as a multiple or as a percentage of the load of the empty elevator car 1. It is then calculated, from the load ratio $P_{ZOB}/P_{ZOL}$, how the pump pressure must rise so that the pressure necessary for moving the elevator car 1 is built up in the pump line 8 at the time point $t_{u2}$. What is advantageously achieved thereby is that the time from the starting command to the commencement of movement of the elevator car 1 is always the same, irrespective of the load.

The rise of the pressure in the pump line 8 is achieved by the control apparatus 20 acting on the control valve unit 15, specifically in such a way that the control valve unit 15 is actuated in the closing direction. Consequently, the return of the hydraulic oil to the tank 11 becomes increasingly more difficult, thus resulting in the desired pressure build-up. How this pressure build-up takes place is illustrated in the $P_Z$ graph by the broken lines $P_{PB}$ for the loaded elevator car 1 and $P_{PL}$ for the empty elevator car 1. When only the load-pressure sensor 18 is present within the scope of the general idea of the invention, the pressure build-up is controlled. If, however, the additional pump-pressure sensor 23 is advantageously present, this pressure build-up can be regulated, in that the pressure build-up according to the curves $P_{PB}$ and $P_{PL}$ functions as a desired value, the control deviation is determined with the aid of the actual pressure $P_P$ measured by the pump-pressure sensor 23 and the control valve unit 15 is activated by means of said control deviation.

Moreover, horizontal reference lines are depicted in the $P_Z$ graoh for the two load situations—empty and loaded elevation car 1. The lowermost reference line represents the pressure $P_{ZOL}$. A further reference line is depicted which is higher by a differential pressure $\Delta P_{dyn}$. The differential pressure $\Delta P_{dyn}$ constitutes a value which is necessary for overcoming hydraulic resistances from standstill to the commencement of movement. The resistances are composed of the force of the spring of the nonreturn valve of the control valve unit 5 (FIG. 1) and the cylinder friction in the lifting cylinder 3. The differential pressure $\Delta P_{dyn}$ also contains a term which takes into account the compressibility of the hydraulic oil. Furthermore, the differential pressure $\Delta P_{dyn}$ is also dependent on the pressure actually prevailing, so that it is advantageous to correct the value according to the actual load, this being carried out, for example, by multiplication by the load ratio mentioned.

The H graph shows that, during the period of time from $t_{U0}$, to $t_{u1}$, activation of the valve control unit 15 does not yet take place, but that the control valve unit 15 is then actuated in the closing direction in the period of time from $t_{u1}$ to $t_{u2}$. This H graph shows two curves, to be precise a curve $H_L$, which shows activation in the case of an empty elevator car 1, and a curve $H_B$, which shows activation in the case of a loaded elevator car 1. At the time point $t_{u2}$, the pump pressure is then just such that the load of the elevator car and the resistances to movement are just overcome.

The two curves $H_L$ and $H_B$ are depicted as straight lines for the sake of simplicity. It is advantageous, however, if the pressure build-up takes place initially quickly and subsequently more slowly. Immediately prior to the time point $t_{u2}$, the pressure build-up is to take place so slowly that an abrupt opening of the nonreturn valve of the control valve unit 5 cannot occur.

As already mentioned before, at a time point $t_{u2}$, the pump pressure is then such that the load of the elevator car 1 and the resistances to movement are just overcome. For the subsequent period of time from the time point $t_{u2}$ to the time point $t_{u3}$, the acceleration is increased from zero to a specific value. In order to achieve this linear rise in acceleration, the rise in time of the cylinder pressure $P_Z$ must be approximately constant, which can be detected from the $dP_Z/dt$ graph, on the one hand, and the $P_Z$ graph, on the other hand. Regulation then takes place, in turn, by a variation in the activation of the control valve unit 15 according to the linearly rising desired value $P_{ZdesB}$ for the loaded elevator car 1 or $P_{ZdesL}$ for the empty elevator car 1. Since acceleration rises from zero to the final value during the period of time from the time point $t_{u2}$ to the time point $t_{u3}$, a smooth start-up automatically takes place, since a parabolic rise in speed occurs automatically. Maximum acceleration is reached at the time point $t_{u3}$.

It should also be mentioned here, in particular, that a desired value for the cylinder pressure $P_Z$ is not required prior to the time point $t_{u2}$. The two desired-value curves $P_{ZdesL}$ and $P_{ZdesB}$ depicted in the $P_Z$ graph therefore commence only at the time point $t_{u2}$.

During the subsequent period of time from the time point $t_{u3}$ to the time point $t_{u4}$, this acceleration is maIntained, so that the speed rises linearly during this period of time.

Since it was recognized that there is the relation $$P_{Zdes} = \left(\frac{M_2}{A_Z}\right)a_{des} - P_{ZO}$$

between the acceleration a and the cylinder pressure $P_Z$, it would have to be assumed that, in the case of the constant acceleration a, the pressure $P_Z$ does not rise any further. In the above-mentioned formula, $M_Z$ signifies the effective mass of the lifting piston 2, together with the elevator car 1, and $A_Z$ the area of the lifting piston 2. As can be seen from the $P_Z$ graph, however, there is provision, according to the invention, even during this period of time, for the desired value $P_{ZdesB}$ for the loaded elevator car 1 or $P_{ZdesL}$ for the empty elevator car 1 to rise further. The reason for this measure is that an increasing pressure loss occurs due to the increasing throughflow speed of the hydraulic oil through the control valve unit 5 (FIG. 1) and through the cylinder line 4. This pressure loss is compensated by the rise in the desired value. It is evident from the $dP_Z/dt$ graph that a slight pressure rise will take place correspondingly. A similar measure is necessary even for the period of time tUl to $t_{u2}$, but is not immediately evident from the curve profile here. Corresponding corrections are to be taken into account in all phases of movement of the elevator car 1.

As is clear from the a, v graph, the acceleration a is reduced to zero again from the time point $t_{u4}$ to the time point $t_{u5}$. This is achieved, in this case by the pressure $P_Z$ being reduced somewhat by the control apparatus 20 according to the desired-value curves $P_{ZdesB}$ or $P_{ZdesL}$. In order to achieve this, the activation of the control valve unit 15 is in this case varied such that it is then actuated further in the closing direction only very slowly. A reversal of the pressure change can be seen accordingly from the $dP_Z/dt$ graph. A parabolic change in the speed, that is to say, again, a smooth transition to another speed, then takes place automatically as a result of the linear decrease in acceleration.

The speed of the elevator car 1 remains constant, that is to say the acceleration is zero, from the time point $t_{u5}$ to the time point $t_{u6}$ according to the a, v graph. The hydraulic resistance accordingly also no longer changes, the result of this being that the desired value $P_{ZdesL}$ or $P_{ZdesB}$ remains constant, which is also clear from the $dP_Z/dt$ graph. In this region, therefore, regulation of the control valve unit 15 with a constant desired value can be carried out, so that the stroke of the valve spindle of the control valve unit 15 changes only if a control deviation occurs.

It is advantageous if, in the period of time from the time point $t_{u5}$ to the time point $t_{u6}$, the activation of the control valve unit 15 is not carried out on the basis of regulation, but is controlled directly. Any control deviations are therefore ignored. The speed is consequently not readjusted. This is expressed in increased traveling comfort, because swings in the regulation of the speed are reliably avoided. The control valve unit 15 is activated correspondingly with a constant desired value.

From the time point $t_{u6}$, then, the elevator car 1 is to be braked according to the a, v graph. This braking operation commences at the time point $t_{u6}$ with the linear build-up of the braking deceleration, so that the acceleration a is increased from the value zero to a final value—a. This linear increase in braking deceleration ends at the time point $t_{u7}$. As mentioned with regard to the change in acceleration between the time points $t_{u2}$ and $t_{u3}$ and also $t_{u4}$ and $t_{u5}$, this change in acceleration results in a parabolic profile of the speed, so that, in this case, the braking operation also commences very smoothly. This effect is brought about by the desired values $P_{ZdesL}$ and $P_{ZdesB}$ being reduced, as is clear from the $P_Z$ graph and from the $dP_Z/dt$ graph. The control valve unit 15 is therefore actuated in the open direction according to these changing desired values.

From the time point $t_{u7}$, the braking deceleration is no longer changed. The speed is in this case reduced linearly. This is again evident from the a, v graph. Here, again, the flow resistances change, that is to say fall in this case, on account of the changing, here falling throughflow speed.

Consequently, the desired value for the pressure $P_Z$, to be precise $P_{ZdesL}$ or $P_{ZdesB}$, is reduced slightly from the time point $t_{u7}$ to the time point $t_{u8}$, in order to compensate this change in the flow resistance.

The braking deceleration is in this case changed linearly toward zero in the period of time from the time point $t_{u8}$ to the time point $t_{u9}$. The desired value for the pressure $P_Z$, that is to say $P_{ZdesL}$ or $P_{ZdesB}$, is further reduced correspondingly, in this case with a lower speed, as is clear from the $dP_Z/dt$ graph. Here, too, a parabolic profile of the speed is obtained automatically, that is to say smooth braking of the elevator car 1 to a standstill.

The set points for the acceleration a, the speed v and the individual time segments from the time point $t_{u2}$ to the time point $t_{u9}$ are selected such that, from the starting point of the elevator car 1, the destination is reached accurately. It is nevertheless advantageous also to employ the conventional shaft switching means, such as magnetic or touch contacts, in the control of the elevator car 1.

Thus, it is shown, according to an example in FIG. 2, how the commencement of deceleration is triggered under the control of such shaft switching means not at the time point $t_{u6}$, but only at the time point $t'_{u6}$. The end of the linear rise in deceleration is shifted correspondingly from the time point $t_{u7}$ to the time point $t'_{u7}$. In this example, therefore, the response of the shaft switching means is awaited. Braking therefore takes place somewhat later, as can be seen from the a, v graph in the same way as from the H graph. For the sake of clarity, the corresponding illustration of the operations in the $P_Z$ graph and in the $dp_Z/dt$ graph has been dispensed with.

If the response of the corresponding shaft switching means coincides with the associated precalculated time points $t_{ux}$, that is to say, for example, $t_{u6}$, which the controller apparatus 20 can recognize, the predetermined parameters are correct. By contrast, if the response does not coincide, there is a need for the correction of the predetermined parameters It is thereby possible to adapt the parameters automatically. It is then not even necessary, when the elevator system is in operation, to switch on a phase with so-called creeping travel shortly before the desired destination is reached.

If the control apparatus 20 is correspondingly of self-adaptive design, it becomes considerably simpler to fix the parameters within the framework of the planning and commissioning of the elevator system.

It should also be noted that, as is clear from the H graph, after the time point tug, the control valve unit 15 automatically runs into the closing position again as soon as the pump 10 is switched off and the pressure in the pump line 8 is reduced again. This results from the reduction of the pressure in the pump line 8 according to the curves $P_{PB}$ and $P_{PL}$ after the time point $t_{u9}$, as illustrated in the $P_Z$ graph.

FIG. 3 shows similar idealized graphs for a downward travel. The four subgraphs correspond in nature and makeup to those of FIG. 2, but, here, no values relating to the pump pressure are illustrated in the $P_Z$ graph, because, during downward travel, the pump 10 does not run and therefore the pump pressure is not relevant. Before the commencement of the downward travel, the respective load is determined by the load-pressure sensor 18 (FIG. 1). On account of the reversed direction of travel, the curves are reflected horizontally in the a, v graph, as compared with FIG. 2, which means, for FIGS. 2 and 3, that the vector of acceleration and speed can also be seen from the a, v graphs. The $dP_Z/dt$ graph again shows the curve profile of the time derivation of the desired value of the pressure $P_Z$.

In the fourth graph illustrated bottommost, again designated as the H graph, in contrast to FIG. 2, the stroke of the valve spindle of the control valve unit 15 (FIG. 1) is not illustrated, but, instead, the stroke of the valve spindle of the control valve unit 5 which, as already mentioned earlier, controls the downward travel.

The time axis t is again common to all four graphs. Individual time points $t_{d0}$ to $t_{d9}$ are illustrated on this time axis and again represent characteristic time points within the framework of control and regulation. The references to the individual subgraphs are illustrated by broken lines.

A downward travel of the elevator car 1 is described below with reference to these graphs. The starting command for downward travel takes place at a time point tdo. The control apparatus 20 (FIG. 1) determines the current value of the load-pressure sensor 18 at this time point.

During downward travel, the pump 10 (FIG. 1) is not switched on. There is no need for it to run, because, during downward travel, the drive is caused solely by the dead-weight of the elevator car 1. The proportional valve of the control valve unit 5 is still closed.

During the period of time from $t_{d0}$ to $t_{d1}$, the control apparatus 20 again calculates the load ratio $P_{ZOB}/P_{ZOL}$ or another corresponding reference variable for effective load, which is required during downward travel in order to activate the proportional valve of the valve control unit 5 in such a way that the desired values for acceleration a and speed v are achieved. This takes account of the fact that, with the elevator car 1 empty, a comparatively lower braking action has to be achieved by means of the control valve unit 5 than with the elevator car 1 loaded.

In the period of time from the time point $t_{d1}$ to the time point $t_{d2}$, then, the control valve unit 5 is activated just such that the differential pressure $\Delta P_{dyn}$ mentioned with regard to upward travel is compensated. This affords the preconditions whereby the movement of the elevator car 1 can commence at the time point $t_{d2}$.

The fall in pressure in the cylinder line 4 is achieved, then, in that the control apparatus 20 acts on the control valve unit 5, specially in such a way that the control valve unit 5 is actuated in the opening direction. Consequently, hydraulic oil can flow from the lifting cylinder 3 through the control valve unit 5 in the direction of the tank 11. The proportional valve, not activated in this case, of the second valve control unit 15 is closed, so that only the nonreturn valve of the second valve control unit 15 is effective. The hydraulic oil flows via this nonreturn valve to the tank 11. It should also be mentioned that the value of the differential pressure $\Delta P_{dyn}$ in this case does not contain a term of the force of the spring of the nonreturn valve of the control valve unit 5, but a term which corresponds to the force of the spring of the nonreturn valve of the second control valve unit 15. The two control valve units 5 and 15 advantageously have the same makeup and the spring constants of the springs of the nonreturn valves are identical. The values for the differential pressure $\Delta P_{dyn}$ are then identical during upward travel and downward travel and are advantageously corrected in the same way as regards the effective load.

It may also be mentioned that, when the proportional valve of the control valve unit 5 opens, a small part of the hydraulic oil can also flow through the pump line 8 and the stationary pump 10 back into the tank 11, because such pumps regularly have a leakage loss.

For the subsequent period of time from the time point $t_{d2}$ to the time point $t_{d3}$, the acceleration is increased from zero to a specific value. In order to achieve this linear rise in acceleration, the fall in time of the cylinder pressure $P_Z$ must be constant, as can be seen from the $dP_Z/dt$ graph, on the one hand, and from the $P_Z$ graph, on the other hand. Regulation then takes place by a variation in the activation of the control valve unit 5 according to the linearly falling desired value $P_{ZdesB}$ for the loaded elevator car 1 or $P_{ZdesL}$ for the empty elevator car 1. Since the acceleration a rises from zero to the final value during the period of time from the time point $t_{d2}$ to the time point $t_{d3}$, a smooth start-up takes place automatically, since a parabolic rise in speed is obtained automatically. Maximum acceleration is reached at the time point $t_{d3}$.

During the subsequent period of time from the time point $t_{d3}$ to the time point $t_{d4}$, this acceleration is maintained, so that the speed rises linearly during this period of time.

Here, again, the pressure losses change due to the rising throughflow speed. Since the pressure losses increase with a rising throughflow speed, the desired value for the cylinder pressure $P_Z$ must be reduced slightly during this phase, this being expressed in a corresponding change in the activation of the valve control unit 5. As already mentioned with-regard to the upward travel, corresponding corrections must be taken into account in all the phases of movement of the elevator car 1.

As is clear from the a, v graph, the acceleration a is reduced to zero again from the time point $t_{d4}$ to the time point $t_{d5}$. This is achieved in this case by the pressure $P_Z$ being increased somewhat by the control apparatus 20 according to the desired-value curves $P_{ZdesB}$ and $P_{ZdesL}$. In order to achieve this, the activation of the control valve unit 5 is in this case varied such that it is then actuated further in the opening direction only very slowly. A reversal of the pressure change can be seen accordingly from the $dP_Z/dt$ graph. A parabolic change in the speed, that is to say, again, a smooth transition to another speed, then takes place automatically as a result of the linear decrease in acceleration.

The speed of the elevator car 1 remains constant, that is to say the acceleration is zero, from the time point td5 to the time point td6 according to the a, v graph. The resistance also accordingly no longer changes, the result of this being that the desired value $P_{ZdesL}$ or $P_{ZdesB}$ remains constant, as is also clear from the $dP_Z/dt$ graph. In this region, therefore, regulation of the control valve unit 5 with a constant desired value takes place, so that the stroke of the valve spindle of the control valve unit 5 changes only if a control deviation occurs.

It is advantageous if, in the period of time from the time point $t_{d5}$ to the time point $t_{d6}$, the activation of the control valve unit D is nor carried out on the basis of regulation, but is controlled directly. Any control deviations are therefore ignored. The speed is consequently not readjusted. This is expressed in increased traveling comfort, because swings in the regulation of the speed are reliably avoided. The control valve unit 5 is activated correspondingly with a constant desired value.

From the time point $t_{d6}$, then, the elevator car 1 is to be braked according to the a, v graph. This braking operation commences at the time point $t_{d6}$ with the linear build-up of the braking deceleration, so that the acceleration a is increased from the value zero to a final value—a. This linear increase in braking deceleration ends at the time point $t_{d7}$. As mentioned with regard to the change in acceleration between the time points td2 and td3 and also td4 and td5l this change in acceleration results in a parabolic profile of the speed, so that, in this case, the braking operation also commences very smoothly. This effect is brought about by the desired values $P_{ZdesL}$ and $P_{ZdesB}$ being increased, as is clear from the $P_Z$ graph and from the $dP_Z/dt$ graph. The control valve unit 5 is therefore actuated in the closing direction according to these changing desired values.

From the time point $t_{d7}$, the braking deceleration is no longer changed. The speed is in this case reduced linearly. This is again evident from the a, v graph. Here, again, the flow resistances change, that is to say fall in this case, on account of the changing, here falling throughflow speed. Consequently, the desired value for the pressure $P_Z$, to be precise $P_{ZdesL}$ or $P_{ZdesB}$ is increased slightly from the time point $t_{d7}$ to the time point $t_{d8}$, in order to compensate this change in the flow resistance.

The braking deceleration is in this case changed linearly toward zero in the period of time from the time point $t_{d8}$ to the time point $t_{d9}$. The desired value for the pressure $P_Z$, that is to say $P_{ZdesL}$ or $P_{ZdesB}$, rises further correspondingly, in this case with a higher speed, as is clear from the $dP_Z/dt$ graph. Here, too, a parabolic profile of the speed, that is to say smooth braking, occurs automatically.

The set said points for the acceleration a, the speed v and the individual time segments from the time point $t_{d2}$ to the time point $t_{d9}$ are again selected such that, from the starting point of the elevator car 1, the destination is reached accurately. It is nevertheless advantageous also to employ the conventional shaft switching means, such as magnetic or touch contacts, in the control of the elevator car 1.

Thus, it is also shown, according to an example in FIG. 3, how the commencement of deceleration is triggered under the control of such shaft switching means not at the time point $t_{d6}$, but only at the time point $t'_{d6}$. The end of the linear rise in deceleration is shifted correspondingly from the time point $t_{d7}$ to the time point $t'_{d7}$. In this example, therefore, the response of the shaft switching means is awaited. Braking therefore takes place somewhat later, as can be seen from the a, v graph in the same way as from the H graph. For the sake of clarity, the corresponding illustration of the operations in the $P_Z$ graph and in the $dp_Z/dt$ graph has been dispensed with.

If the response of the corresponding shaft switching means coincides with the associated time points $t_{dx}$, that is to say, for example, $t_{d6}$, which the control apparatus 20 can recognize, the predetermined parameters are correct. By contrast, if the response does not coincide, there is a need for the correction of the predetermined parameters. It is thereby possible, in turn, to adapt the parameters automatically. It is therefore also not necessary during downward travel to switch on a phase with so-called creeping travel shortly before the desired destination is reached.

If the control apparatus 20 is of correspondingly self-adaptive design, adaptation may therefore also take place during downward travel.

In order to determine the desired traveling curves, the necessary time profile of the pressure $P_Z$ is determined from the desired values for acceleration and speed and is stored as a desired traveling curve in the form of a desired-value/time series in a desired-value generator of the control apparatus 20. The respectively current actual value of the pressure $P_Z$ is determined with the aid of the load-pressure sensor 18 and is compared with the desired value. The controlling command is generated from the difference between the actual value and desired value by means of the conventional methods of regulation technology. This controlling command acts on the control valve unit 15 during upward travel and on the control valve unit 5 during downward travel.

According to the invention, therefore, there is provision, with the elevator car 1 at a standstill, for determining the load on the elevator car 1 by the load-pressure sensor 18 detecting the pressure $P_Z$ in the cylinder line 4, for the upward travel of the elevator car 1 to be regulated by a variation in the activation of the second control valve unit 15, in that a desired traveling curve dependent on the load on the elevator car 1 and representing a time profile of the pressure in the cylinder line 4 is compared with the continuous changes in the pressure in the cylinder line 4, the controllino command for the second control valve unit 15 being generated from the control deviation, and for the downward travel of the elevator car 1 to be regulated by a variation in the activation of the first control valve unit 5, in that a desired traveling curve dependent on the load on the elevator car 1 and representing a time profile of the pressure in the cylinder line 4 is compared with the continuous changes in the pressure in the cylinder line 4, the controlling command for the first control valve unit 15 being generated from the control deviation.

Consequently, only the load-pressure sensor 18 is necessary both for the entire upward travel and for the entire downward travel in order to regulate the movement of the elevator car 1 reliably.

Various alternative embodiments are possible within the scope of the invention. The load-pressure sensor 18 may, for example, be placed directly in the control valve unit 5 and also in the pilot control chamber of the latter.

It may also be advantageous if regulation does not take place during upward and downward travel in the region of the desired traveling curve with a decreasing speed, but, instead, during upward travel, the second control valve unit (15), and, during downward travel, the first control valve unit (5) are activated directly with a time-variable desired value. In this case, within the adaptation framework, adaptation of the desired values and of their change in time is possible with the cooperation of the switching elements arranged in the car shaft.

If necessary, in connection with the present invention, creeping travel may be switched on before the elevator car stops, if the destination position is not reached directly due to particular circumstances. In this case, the initiation and the end of creeping travel are triggered in a known way by switching elements arranged in the car shaft.

What is claimed is:

1. A method for controlling a hydraulic elevator, the elevator car (1) of which is capable of being moved by means of a hydraulic drive consisting of a lifting piston (2) and of a lifting cylinder (3), in that hydraulic oil is capable of being conveyed through a cylinder line (4) into the hydraulic drive (2, 3) and out of the hydraulic drive (2, 3) by means of a pump (10) and with the cooperation of a first control valve unit (5) and a second control valve unit (15), the flow of hydraulic oil being capable of being checked by measuring means, the pressure in the cylinder line (4) being capable of being detected by means of a load-pressure sensor (18), and the function of the elevator being capable of being controlled and regulated by means of a control apparatus (20) carrying out the method, comprising:

determining, with the elevator car (1) at a standstill, the load on the elevator car (1) by the load-pressure serisor (18) detecting the pressure $P_Z$ in the cylinder line (4), regulating the upward travel of the elevator car (1) by a variation in the activation of the second control valve unit (15), in that a desired traveling curve dependent on the load on the elevator car (1) and representing a time profile of the pressure in the cylinder line (4) is compared with the continuous changes in the pressure in the cylinder line (4), the controlling command for the second control valve unit (15) being generated from the control deviation, regulating the downward travel of the elevator car (l) by a variation in the activation of the first control valve unit (5), in that a desired traveling curve dependent on the load on the elevator car (1) and representing a time profile of the pressure; in the cylinder line (4) is compared with the continuous changes in the pressure in the cylinder line (4), the controlling command for the first control valve unit (5) being generated from the control deviation.

2. The method as claimed in claim 1, characterized in that regulation does not take place during upward and downward travel in the region of the desired traveling curve with a constant speed, but, instead, during upward travel, the second control valve unit (15) and, during downward travel, the first control valve unit (5) are activated directly with a constant desired value.

3. The method as claimed in claim 1, characterized in that regulation does not take place during upward travel and downward travel in the region of the desired traveling curve with a decreasing speed, but, instead, during upward travel, the second control valve unit (15) and, during downward travel, the first control valve unit (5) are activated directly with a time-variable desired value.

4. The method as claimed in claim 1, characterized in that the change in time of the pressure $P_Z$ is evaluated by the control apparatus (20), in that the acceleration acting on the elevator car (1) is determined from the size and gradient of this change in time.

5. The method as claimed in claim 4, characterized in that the speed of the elevator car (1) is determined by the integration of the acceleration.

6. The method as claimed in claim 5, characterized in that the distance covered by the elevator car (1) is determined by the integration of the speed.

7. The method as claimed in claim 1, characterized in that the pressure $P_P$ generated in the pump line (8) by the pump (10) and influenced by the second control valve unit (15) is determined by means of a pump-pressure sensor (23), so that the pressure in the pump line (8) can be measured and therefore the stepped or continuous change in the pressure rise can, if appropriate, also be regulated.

8. The method as claimed in claim 7, characterized in that the difference between the pressure $P_Z$ determined by the load-pressure sensor (18) and the pressure $P_P$ determined by the pump-pressure sensor (23) is formed in the control apparatus (20), and in that this difference is used for determining the Flow of hydraulic oil in the cylinder line (4).

9. The method as claimed in claim 7, characterized in that the pump-ressure sensor (23) is designed as a differential-pressure sensor determining a differential pressure $P_D$ which corresponds to the difference between the pressure $P_Z$ prevailing in the cylinder line (4) and the pressure $P_P$ prevailing in the pump line (8).

10. The method as claimed in claim 1, characterized in that the temperature of the hydraulic oil is determined by means of a temperature sensor (21) arranged on the first control valve unit (5) and is taken into account by the control apparatus (20) in the control of the elevator.

11. A device for controlling a hydraulic elevator, the elevator car (1) of which is capable of being moved by means of a hydraulic drive consisting of a liffing piston (2) and of a lifting cylinder (3), in that hydraulic oil is capable of being conveyed from a tank (11) through a pump line (8) to at least one control valve unit (5, 15) and from the latter through a cylinder line (4), in which the pressure can be measured by means of a load-pressure sensor (18), to the hydraulic drive, the quantity stream of hydraulic oil being capable of being controlled with the cooperation of at least one of the control valve units (5, 15) and of being checked by measuring means, and the pump (10) and at least one of the control valve units (5, 15) being capable of being controlled by a control apparatus (20), comprising:

a first control valve unit (5) and a second control valve unit (15) being capable of being activated by the control apparatus (20), said the control apparatus (20) containing desired traveling curves for upward travel and downward travel in a desired-value generator, each desired traveling curve representing a time profile of the pressure $P_Z$ in the cylinder line (4), said control apparatus (20), during upward travel and downward travel, compares the respective actual values of the pressure $P_Z$ with the desired values and activates the second control valve unit (5) during upward travel and the first control valve unit (15) during downward travel according to the control deviation, and said control apparatus (20) does not activate the pump (10) when the elevator car (1) , to execute movement in the downward direction.

12. The device as claimed in claim 11, characterized in that there is as measuring means a pump-pressure sensor (23) which detects the pressure $P_P$ in the pump line (8), in that the signal from the load-pressure sensor (18) can be fed to the control apparatus (20), and in that the control apparatus (20) is such that it can generate from the signal from the load-pressure sensor (18) additional data by means of which the pressure $P_P$ can be regulated by the control apparatus (20) with the activation of the second control valve unit (15).

* * * * *